US005556122A

United States Patent [19]

Arduin et al.

[11] Patent Number: 5,556,122

[45] Date of Patent: Sep. 17, 1996

[54] DEVICE FOR MODIFYING THE FORCE DISTRIBUTION OF A SKI OVER ITS GLIDING SURFACE AND A SKI EQUIPPED WITH SUCH A DEVICE

[75] Inventors: Joël Arduin, Metz-Tessy; Jacques Le Masson, Cran-Gevrier, both of France

[73] Assignee: Salomon S.A., Metz-Tessy, France

[21] Appl. No.: 256,629

[22] PCT Filed: Dec. 2, 1992

[86] PCT No.: PCT/FR92/01120

§ 371 Date: Jul. 29, 1994

§ 102(e) Date: Jul. 29, 1994

[87] PCT Pub. No.: WO93/14837

PCT Pub. Date: Aug. 5, 1993

[30] Foreign Application Priority Data

Jan. 31, 1992 [FR] France ..... 92 01248

[51] Int. Cl.[6] ..... A63C 5/07

[52] U.S. Cl. ..... 280/602; 280/607; 280/618

[58] Field of Search ..... 280/602, 607, 280/609, 615, 617, 618, 633, 634

[56] References Cited

U.S. PATENT DOCUMENTS

| | | | |
|---|---|---|---|
| 2,560,693 | 7/1951 | Hickman | 280/11.13 |
| 3,260,532 | 7/1966 | Heuvel | 280/602 |
| 5,129,668 | 7/1992 | Hecht | 280/618 |
| 5,135,250 | 8/1992 | Abondance et al. | 280/617 |
| 5,332,252 | 7/1994 | Le Masson et al. | 280/607 |
| 5,332,253 | 7/1994 | Couderc et al. | 280/602 |
| 5,393,086 | 2/1995 | Le Masson et al. | 280/602 |
| 5,397,149 | 3/1995 | Couderc et al. | 280/602 |

FOREIGN PATENT DOCUMENTS

| | | | |
|---|---|---|---|
| 1270867 | 6/1990 | Canada | A63C 5/00 |
| 0182776 | 5/1986 | European Pat. Off. | A63C 9/00 |
| 0183586 | 6/1986 | European Pat. Off. | A63C 9/00 |
| 0409749 | 1/1991 | European Pat. Off. | A63C 9/00 |
| 2259375 | 6/1974 | Germany . | |
| 4101997 | 9/1991 | Germany | A63C 9/00 |

*Primary Examiner*—Anne Marie Boehler
*Attorney, Agent, or Firm*—Greenblum & Bernstein P.L.C.

[57] ABSTRACT

A device for modifying the pressure distribution of a ski, such as especially an alpine ski over its gliding surface, as well as to a ski equipped with such a device. The ski is equipped with at least one binding element adapted to retain a boot in the central zone of the middle sole, and at least one support element on which the sole of the boot rests. Moreover, the ski includes a lower base, and above the base, a stiffening blade, both of whose ends are fixedly connected to the base at the front and rear of the middle sole zone. The device includes, in addition, a sensor element in contact with the sole of the boot, mobile along a vertical direction. It also includes a connection between the sensor element and stiffening blade in order to transmit to the blade, in the form of at least one longitudinally or horizontally oriented force in the direction of either one and/or the other of its ends, at least a portion of the downward vertical thrust of the boot captured by sensor element.

31 Claims, 13 Drawing Sheets

1
2
3
4
5
6
7
8
10
12
13
14
37
38

2
3
4
5
6
7
8
10
12
13
14
37
38

37
13
2
17
5
10

37
18
18
13
17
5
4
10

38
28
22
14
26
32
34
25
35
43
36
39
37
5

25
36
49
55
56
53
52
48
50
37
38
35
43
4
51

25
35
42
4
55
49
56
53
52
51
48
50
37

DEVICE FOR MODIFYING THE FORCE DISTRIBUTION OF A SKI OVER ITS GLIDING SURFACE AND A SKI EQUIPPED WITH SUCH A DEVICE

BACKGROUND OF THE INVENTION

1. Field of the Invention

The invention is related to a device for distributing the pressure of a ski, such as especially an alpine ski, over its gliding surface.

The ski is also related to an assembly of front and rear binding elements for alpine skis, as well as an alpine ski, equipped with such a device.

2. Description of Background and Relevant Information

Skis that are used for alpine skiing are constituted by relatively long beams, on which the boots of the skier are retained by front and rear binding elements. The boot and the binding elements are located approximately in the median zone of the ski, which is commonly known as the middle sole. When at rest, the skis exhibit a natural arch, whereby the blade is naturally raised with respect to the front end of the ski, or shovel, and the rear end of the ski, or tail. In addition, the skis have a flexibility that depends on their internal structure. While skiing, the ski is elastically deformed in response to the various forces to which it is subjected by the skier, as well as by the terrain over which it glides.

The foremost stress to which a ski is subjected is constituted by the weight of the skier and the reaction to which the gliding surface subjects the ski.

The ski is also biased by the binding elements. Indeed, it is known that the binding elements pinch the boot along a longitudinal direction. The reaction to this pinching action is transmitted by the binding elements to the ski. However, this reaction differs depending on the assembly mode of the rear binding element to the ski. In fact, some binding elements are assembled directly onto the ski, whereas others are assembled to the front binding element by an inextensible link, such as a metallic blade that extends beneath the boot.

The ski is also influenced by the position of the skier above his or her boots, depending on whether the skier carries his or her weight towards the front or towards the rear.

It is known that the behavior of the ski on the snow can be modified, especially its ease of turn initiation, its operational quality in turns or in a straight line, by influencing the camber of the ski, or by varying the longitudinal pressure distribution of the ski on the snow. It is known that the ski can be rendered more or less pivoting, or more or less guiding, by varying this pressure distribution, i.e., one can promote its ability to take turns easily, and its ability to manifest substantial operational stability. For skis that are currently on the market, the pressure distribution of the ski on the snow is mainly determined by the internal structure of the ski and by the assembly mode of the binding elements to the ski, i.e., with or without a connecting blade between the front and rear binding elements. Pressure distribution can also be influenced by the intensity of thrust provided to the return springs that determines the pinching of the boot between its binding elements.

There are devices with attached elements that enable the pressure distribution of the ski on snow to be modified. As such, European patent application No. 183,586 describes a blade made of an elastic material of the spring blade type attached above the ski, between the binding elements and the ski. This blade has cursors in the area of its front and rear ends, whereby a portion of the stresses to which the ski is subjected is transmitted vertically. However, this device has the disadvantage of mediocre performance with substantial space requirements. It is adapted for the case where both feet of the skier are in support on the same ski, in order to avoid the entire weight of the skier from being concentrated in the middle sole zone. On the other hand, it is ill-adapted in the case of a pair of conventional skis.

European patent application No. 409,749 discloses a device constituted by a plate which is raised with respect to the upper surface of the ski, maintained between two longitudinal abutments. Elastic shock absorption means are inserted between the plate and the abutments and the prestress exerted on these elastic means is adjustable. As for the bindings, they are mounted on the plate. This device provides good results, but its disadvantage lies in the fact that the binding elements are affixed to the attached plate and not to the ski itself. Other devices of the same type are described, for example, in the U.S. Pat. No. 2,560,693, and the German patent No. 22 59 375.

It should be noted that the influence exerted by these devices on the flexion of the ski is of the static type, i.e., they do not take into account the position of the skier on the skis while gliding.

SUMMARY OF THE INVENTION

One of the objects of the invention is to provide a device that enables the dynamic modification of the pressure distribution of a ski over its gliding surface, i.e., that takes into account, while gliding, the position of the skier on the skis, and the vertical thrust force of the skier on the skis.

Another object of the present invention is to provide a device that also provides a suspension effect to the boot while gliding.

Another object of the invention is to provide a device that enables momentary increases of the pressure exerted by a portion of the ski on the snow to be compensated, by sending this additional pressure to another portion of the ski.

Another object of the invention is to provide a device that has shock absorption qualities for the vertical vibrations of the ends of the ski.

Other objects and advantages of the invention will become apparent from the description that follows, such description being provided, however, only as an example and being non-limiting.

The device according to the invention is intended to modify the pressure distribution of a ski, such as especially an alpine ski over its gliding surface. The ski is equipped with at least one binding element adapted to retain a boot in support on a ski in its central zone or middle sole zone, and with at least one support element on which the sole of the boot rests. The ski includes, in addition, a lower base whose front end is raised to form the shovel and a stiffening blade that extends freely above the base in its central portion, and both of whose ends are connected to the base at the front and at the rear of the middle sole zone.

The device also includes:

—a sensor element in contact with the sole of the boot, adapted to capture the vertical forces of at least a portion of the sole of the boot, —connection means between the sensor element and the stiffening blade in order to transmit at least a portion of the downward vertical thrust of the boot captured by the sensor element to the stiffening blade, in the form of at least one force oriented along the horizontal and longitudinal direction of the blade in the direction of at least one of its ends.

BRIEF DESCRIPTION OF THE DRAWINGS

The invention will be better understood with reference to the description hereinbelow, as well as to the annexed drawings that form an integral part thereof.

DETAILED DESCRIPTION OF THE PREFERRED EMBODIMENTS

Figure 1:
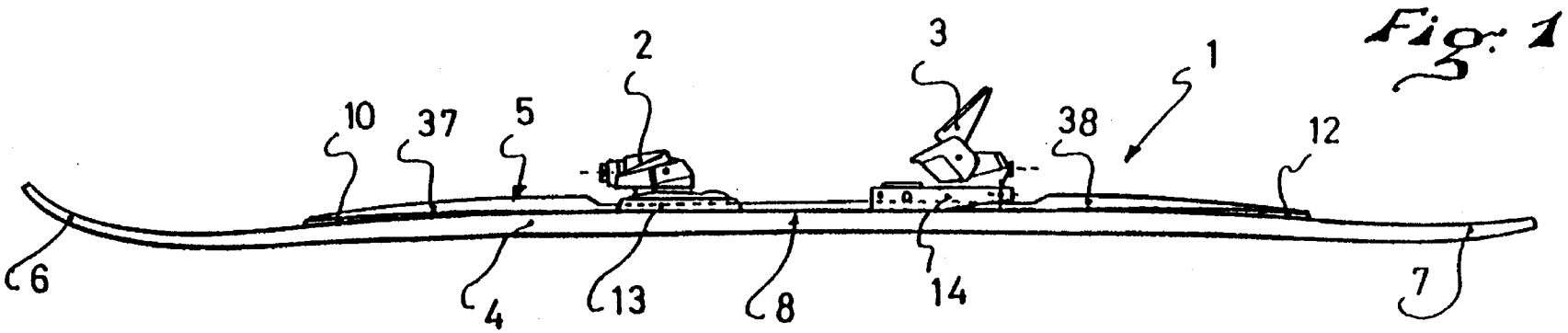
FIG. 1 is a general side elevation view of a ski equipped with front and rear binding elements, and a device according to a non-limiting embodiment of the invention.

So as to illustrate the invention, FIG. 1 represents a ski 1 that is equipped especially with a front binding element 2 and a rear binding element 3. Both these binding elements 2 and 3 are adapted to retain the front and rear ends of a boot on the ski. Ski 1 comprises two elements, a lower base 4 and an upper stiffening blade 5. Lower base 4 has an elongate shape, and it is this element that comes into contact with the snow. Its front end 6 is raised to form the shovel of the ski. Its rear end 7 constitutes the tail of the ski. Binding elements 2 and 3 are affixed to the base in its central zone 8, which is also called the middle sole zone.

Figure 2:
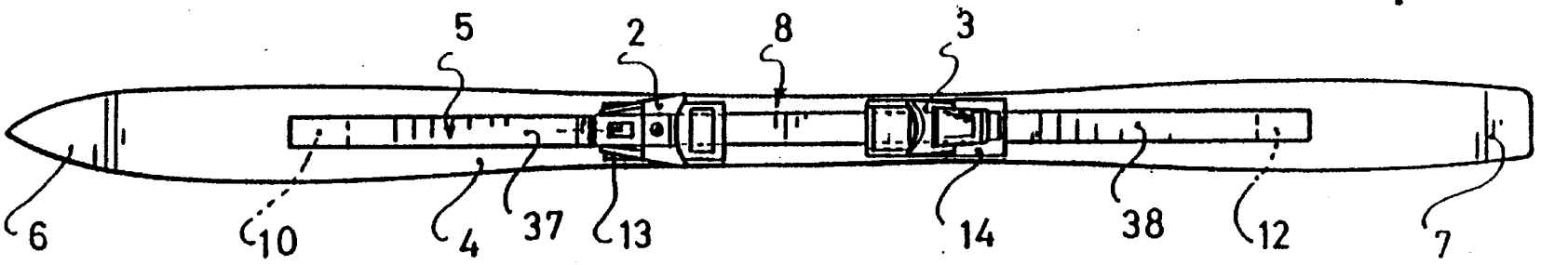
FIG. 2 is a top plan view of the ski represented in FIG. 1.

The stiffening blade 5 also has an elongate shape, and it extends above base 4. According to FIG. 2, the width of stiffening blade 5 is constant and less than that of base 4. This is not limiting, and stiffening blade 5 can have variable width over its length. The thickness of stiffening blade 5 can also vary over the length of such blade, and in the drawings, the thickness of stiffening blade 5 is reduced in the middle sole zone. This characteristic is not limiting either.

The stiffening blade is made of any appropriate material adapted to transmit a compression force along its length. Preferably, the material of the blade is selected such that the blade also has flexional elasticity in a vertical plane. For example, it is made of a composite material, possibly with fiber fillers.

The stiffening blade 5 extends above base 4, from a zone that is located in the front portion of the ski, i.e., between shovel 6 and middle sole 8, to a zone located in the rear portion of the ski, i.e., between tail 7 and middle sole 8. The stiffening blade 5 extends freely above the base in its central zone, and is affixed to base 4 in the area of its ends.

With reference to FIG. 1, stiffening blade 5 is affixed, at its front end 10 and its rear end 12, to the upper surface of base 4, such zones being located approximately at the front quarter and the rear quarter of the ski.

The ends of blade 5 are affixed to base 4 by any appropriate means, for example, by screwing, adhesion or welding. They can also be affixed by joining pieces connected to the base against which they are in abutment. In addition, a layer of material exhibiting shock absorption characteristics can be inserted between the ends of the stiffening blade and the upper surface of the base.

The front 2 and rear 3 binding elements are fixedly connected to base 4 of the ski.

Figure 3:
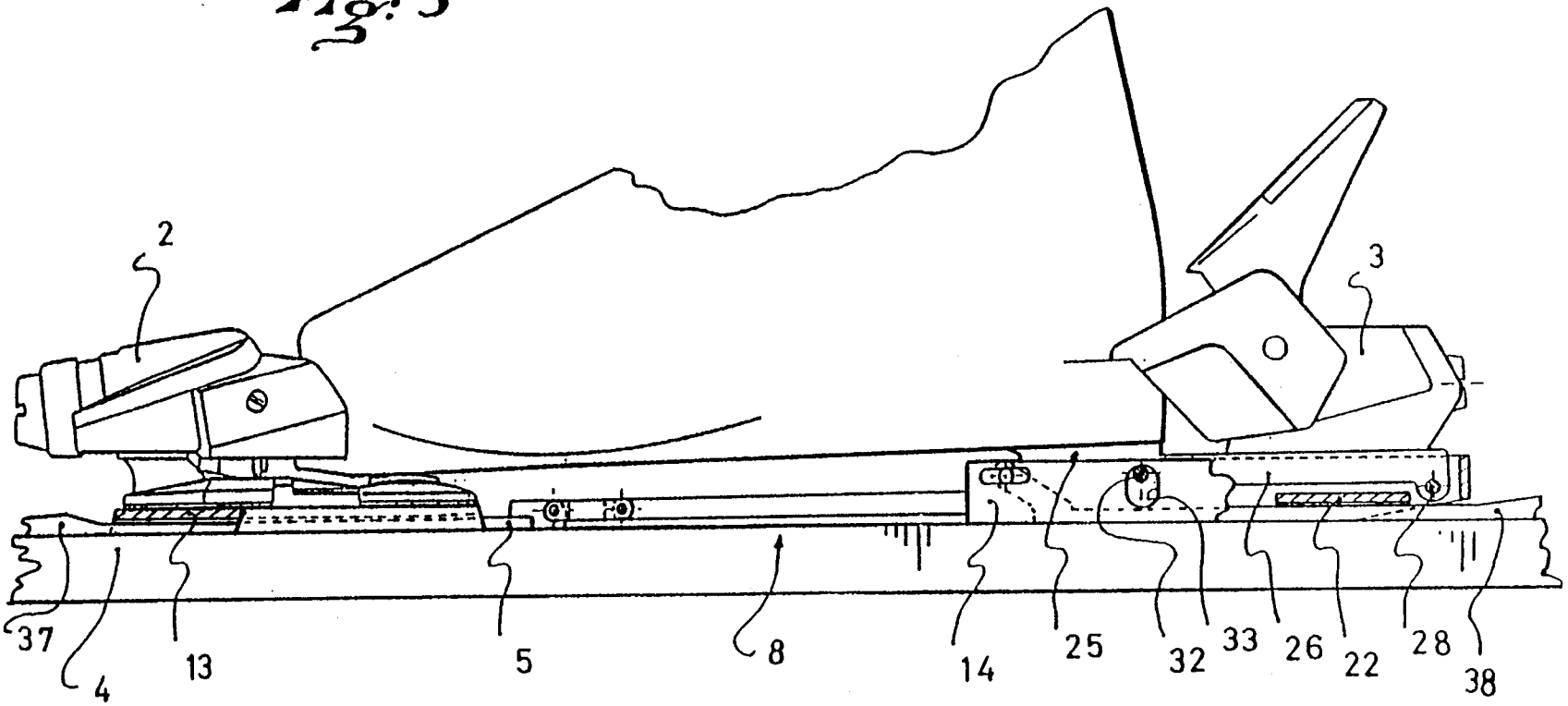
FIG. 3 represents, in a side elevation and partial sectional view, the ski of FIG. 1 in the middle sole zone.
Figure 4:
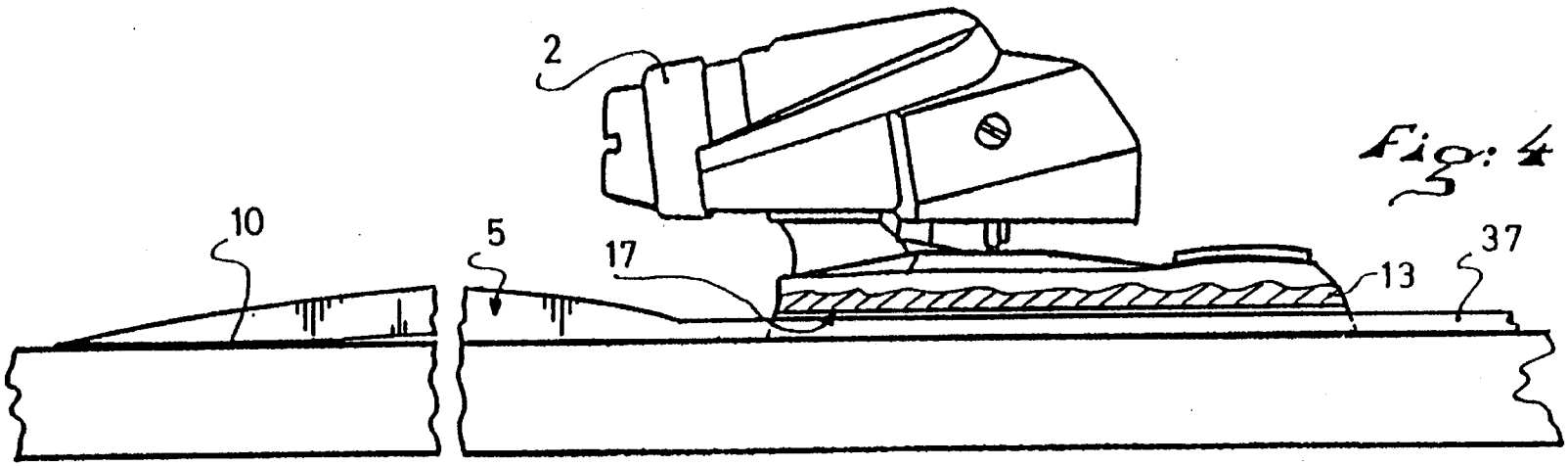
FIG. 4 represents, in a side elevation and partial sectional view, the front portion of the ski of FIG. 1.
Figure 5:
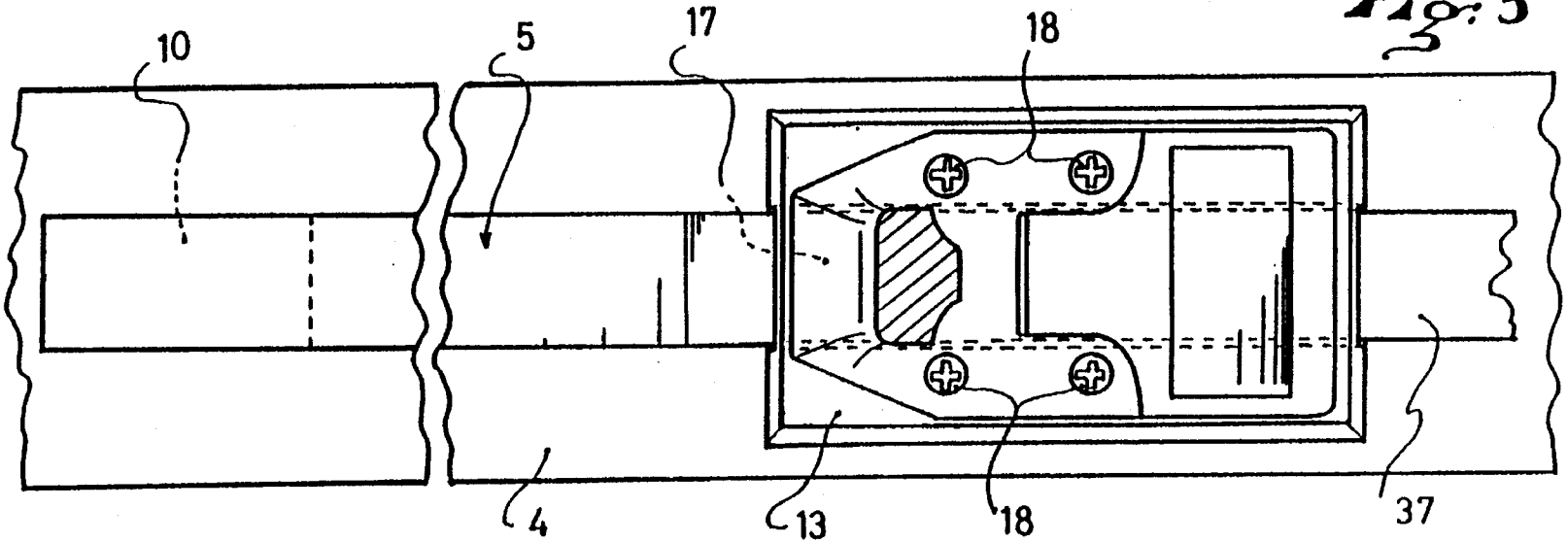
FIG. 5 is a top plan partial sectional view according to a horizontal plane of the device represented in FIG. 4.

FIGS. 3 through 5 show that the front binding element 2 is mounted on a base plate 13 that is U-shaped in a transverse section. This base plate 13 straddles stiffening blade 5 and it rests on the upper surface of base 4 by its lateral edges. Base plate 13 has, in its lower portion, a longitudinal recess 17 within which stiffening blade 5 can slide freely along a longitudinal direction.

According the embodiment illustrated, screws 18 ensure the affixing of binding element 2 and base plate 13 to the base. All other appropriate means may also suffice.

Figure 6:
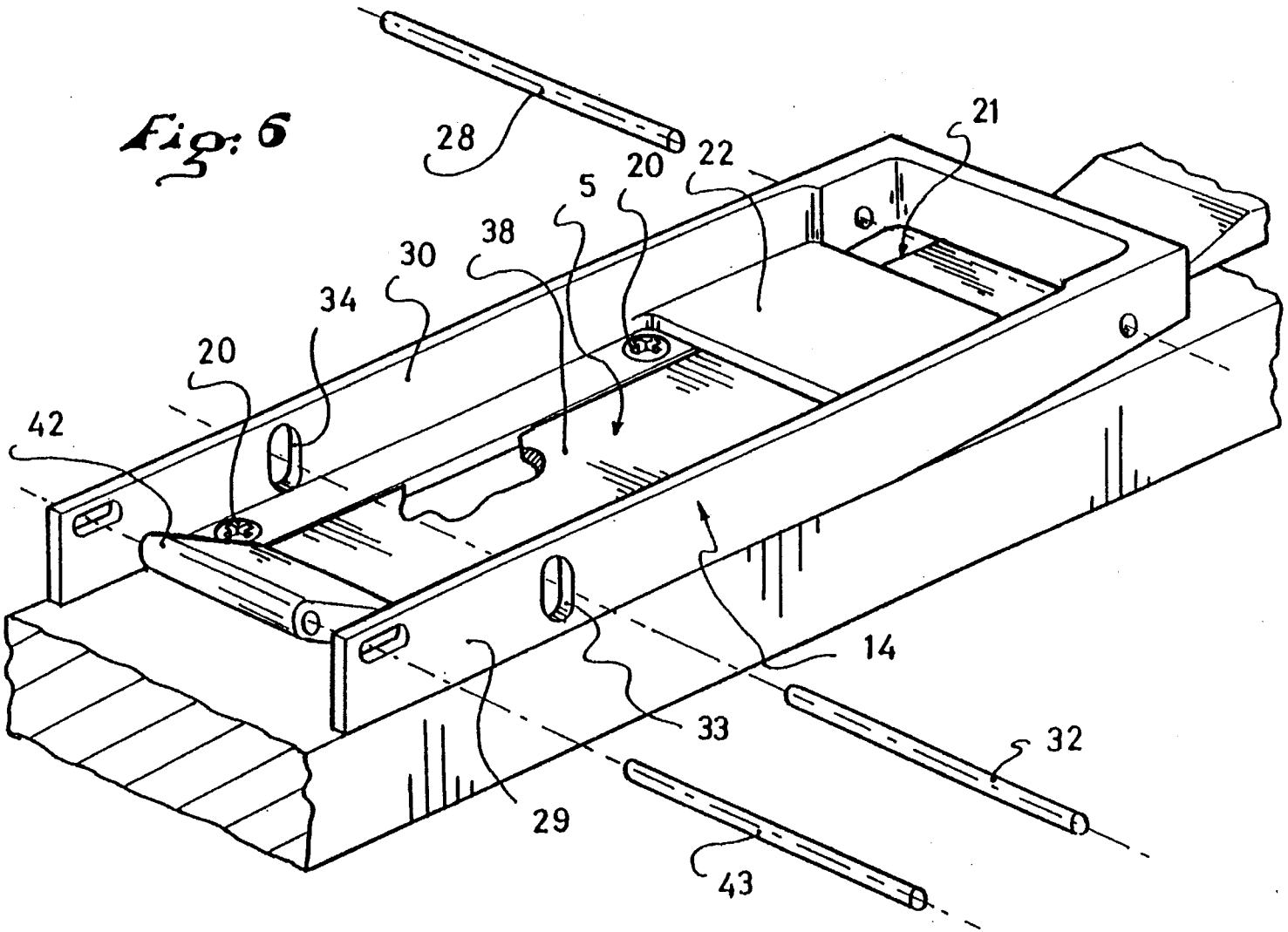
FIG. 6 represents a perspective view of the base that supports the rear binding element.

FIGS. 3 and 6 show moreover that rear binding element 3 is mounted on the ski by means of a base plate 14 which is affixed to base 4 by any appropriate means, and in the example illustrated, by screws 20 located on the lateral edges of the base plate. Similarly to the front base plate, rear base plate 14 has a longitudinal recess 21 within which stiffening blade 5 is engaged along a longitudinal direction, and can slide freely. In the embodiment illustrated in FIG. 6, element 21 is only closed, in its upper portion, on the rear by a transverse strip 22 that connects the two lateral edges of base 14.

It must be stressed that base plates 13 and 14 ensure the connection between binding elements 2 and 3 and base 4 of the ski, and also assume the role of vertically retaining stiffening blade 4 so as to stop it from buckling, and as such, to maintain it in the vicinity of the upper surface of the base.

It must also be noted that base plates 13 and 14 are affixed to base 4 and not to blade 5. The support elements associated to binding elements 2 and 3, on which the boot rests, and the binding elements themselves that retain the boot are therefore also connected to the base of the ski. This ensures that good tracking qualities are retained since the forces between the base and the boot are transmitted directly, without passing via blade 5.

While skiing, stiffening blade 5 influences the flexion of base 4 in different ways. Firstly, stiffening blade 5, by means of its front portion and its rear portion, returns the flexional biases of the front end or the rear end of the base to the middle sole zone. In other words, if the ski is flexionally biased upwardly in its shovel zone, the front portion of stiffening blade 5 transmits this flexional bias to the middle sole zone, which can be translated by a low-amplitude longitudinal sliding of the blade with respect to the base or a compression bias brought back by the blade. This goes for the tail as well.

In parallel, blade 5 can generate flexional stresses on the front end or the rear end of the ski. For example, a forward longitudinal thrust, exerted on the front portion of blade 5, is transmitted to base 4, in its front zone, in the form of a flexional moment that tends to make the front end of the ski plunge towards the snow. The same holds true for a rearward longitudinal thrust that could be exerted on the rear portion of stiffening blade 5, such thrust generating a flexional moment for the rear end of the ski which would tend to make this end plunge towards the snow. The flexional moment is mainly exerted on the ski in the area of ends 10 and 12 of the blade which are affixed to base 4.

In the hypothesis where stiffening blade 5 behaves like an integral assembly along a longitudinal direction, a flexional bias of the base, captured in the area of one end of the ski, will be transmitted to the other end in the form of a flexional moment. Thus, an upward flexional bias of the front portion of the ski generates a downward flexional moment of the rear portion. Inversely, an upward bias of the rear portion generates, by reaction, a downward flexional moment of the shovel. These different biases occur during the glide, either due to the terrain that the ski encounters along its path, or due to the position of the skier on the skis. A flexional bias of one end of the ski is most often accompanied by a localized increase in pressure exerted by the ski on the snow in the area of that end. This localized increase in pressure is transmitted by blade 5 towards the other end of the ski which it tends to plunge towards the snow. This increases the grip, on the snow, of that portion of the ski which is not flexionally biased, thus rebalancing the pressure distribution of the ski on the snow.

In the case where stiffening blade 5 is constituted by two portions that do not constitute an integral assembly along a longitudinal direction, the biases captured by each of the portions are brought back into the middle sole zone; inversely, it is possible to generate, from the middle sole zone, longitudinal thrust forces on the front portion or the rear portion of the blade, which in turn generate flexional moments for the front end or the rear end of the base.

Moreover, the front and rear portions of stiffening blade 5 respectively have an elastic flexibility in the vertical and longitudinal plane defined by the ski. Thus, they too assume a shock absorbing role for the vertical vibrations on the front and rear portions of base 4.

The device that is the object of the present invention also has a sensor element, for connection with the sole of the boot, that is adapted to capture at least the downward vertical biases that the sole exerts on it.

Furthermore, the device comprises connection means between the sensor element and stiffening blade 5, that transform the vertical biases of the boot into one or two longitudinal thrust forces in the area of stiffening blade 5, oriented towards the front end and/or the rear end thereof.

Thus, the sensor element, the connection means and stiffening blade 5 are capable of generating flexional moments for the front end and/or rear end of the ski from the vertical biases that the boot exerts on the sensor element. This is superposed onto the front-rear transmission function described previously. Due to this, a flexional moment can be generated in the area of one end of the ski, or even by a flexional bias that is produced in the area of the other end, or even by a vertical bias of the boot.

According to the embodiment illustrated in the drawings, the sensor element is constituted by a support element 25, which is associated with the rear binding element 3, and on which the rear end of the sole of the boot rests.

In a known manner, the body of rear binding element 3 is slidably mounted along a slide 26, and support element 25, which constitutes the sensor element, extends slide 26 which is also connected to base plate 14, in its rear portion, by a horizontal and transverse journal axis 28. In fact, base plate 14 has two longitudinal and vertical wings 29 and 30 between which stiffening blade 5 passes, and between which is located base plate 14. These wings bear axle 28 in their rear portion. Slide 26, and therefore sensor element 25, have a rotational movement about the axis of axle 28 in the median longitudinal and vertical plane defined by the ski. Conversely, axle 28 does not allow a rocking movement of sensor 25.

The vertical forces of the boot are absorbed by the vertical movement of sensor 25 about the axis of axle 28. The transverse rocking biases, inversely, are transmitted directly to base 4 of the ski.

Axle 28 is not limiting, and any other assembly mode of binding element 3 that ensures a vertical movement of sensor element 25 can be envisioned.

Preferably, the rotational movement of slide 26 is limited downwardly and upwardly. The restraining means are represented in the drawings by a horizontal and transverse pin 32, located in the front portion of slide 26. The ends of pin 32 rotate within the vertically oriented slots 33 and 34 that are respectively borne by wings 29 and 30 of base plate 14. The rotational movement is limited by the ends of pin 32 coming into abutment in the upper portion or the lower portion of slots 33 and 34.

A spring or a shock absorbing block could be placed between slide 26 and base plate 14 in order to bring back the slide upwardly and to oppose or absorb its downward movement.

Figure 7:
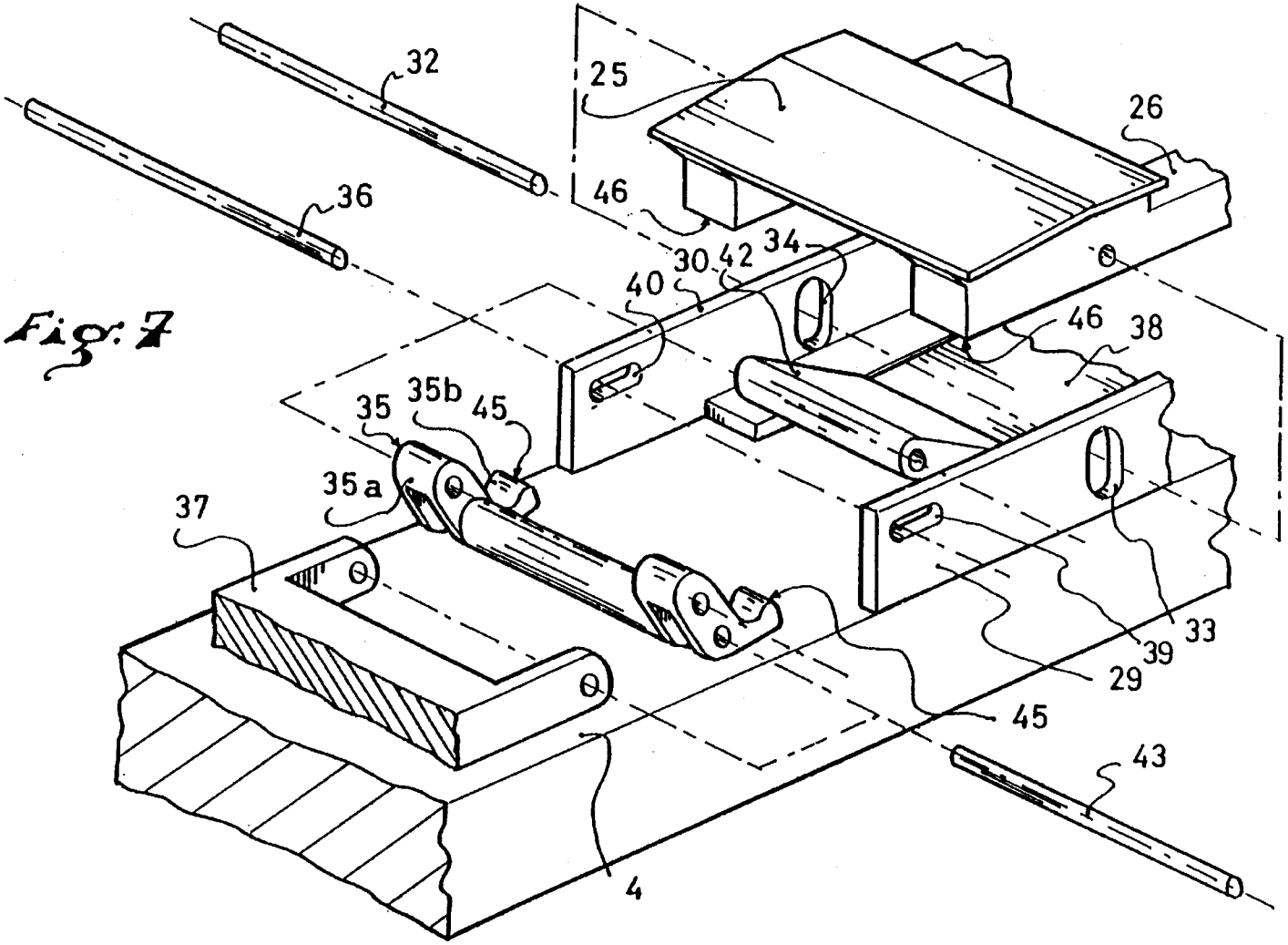
FIG. 7 is an exploded, perspective view in the area of the sensor and the connection means that are located under the sensor.

The connection means that connect sensor element 25 to connecting blade 5 are especially visible in FIG. 7. As shown this drawing, stiffening blade 5 is constituted by two portions, i.e., a front member 37 and a rear member 38 that are joined in the area of sensor element 25.

The connection means comprise a pivotable element 35 which, in a side view, has an approximate L shape with a vertical arm **35*a* and a horizontal arm 35*b*. Pivotable element 35 is suspended about an axle 36 which is located in the upper portion of its vertical arm 35*a*. Axle 36 is itself borne, in the area of its ends, by wings 29 and 30 of base plate 14, in the area of the two oblong holes 39 and 40 which are oriented along a longitudinal and horizontal direction. Also, axle 36 crosses the front end of rear member 38 that preferably has, in this area, a joining piece 42. Axle 36** thus ensures the connection between the rear member and the connection means.

Moreover, an axle 43 is located in the central portion of pivotable element 35, i.e., under the level of axis 36, at the junction of the vertical and horizontal arms. Axle 43 ensures the connection, by journal, between pivotable element 35 and the rear end of front member 37.

Pivotable element 35 also comprises, in the area of the free end of its horizontal arm **35*b***, a support zone on surface 45 on which sensor element 25 comes to rest along a vertical direction by means of slide 26. In the example illustrated, support zone 45 is made up of two portions that are located on either side of front end 42 of rear member 38. The slide comes to rest, along a vertical direction, on support zones 45 by two lateral plates 46.

The assembly described hereinabove is sized in such a way that the pivoting of slide 26 can be produced, in a longitudinal and vertical plane about axis 28, over an amplitude defined by axle 32 and slots 33 and 34 that the ends of the axle cross. During this movement, the lateral plates 46 of slide 26 are in support on zones 45 of pivotable element 35 and cause its rotation about the axis of axle 36 which is borne by oblong holes 39 and 40. The rotational movement of pivotable element 35, a result of a downward movement by sensor element 25, causes a relative spacing of front and rear members 37 and 38 along a longitudinal direction. Conversely, the relative movement of members 37 and 38 toward each other corresponds to the rotation of the pivotable element in the opposite direction and to the rise of sensor element 25.

Preferably, at rest, i.e., in the normal position of the ski, the members transmit a compression pre-stress to the pivotable element, that tends to maintain sensor element 25 in the raised position.

Moreover, abutment means limit the relative coming together of members 37 and 38, i.e., they ensure the affixation of the members for a longitudinal movement in the direction of their joining.

In the embodiment, these means are constituted by the ends of pin 32 and slots 33 and 34 of the rear binding element.

In fact, when pin 32 is in upward abutment in slots 33 and 34, the rotational movement of pivotable element 35, in the direction of a relative coming together of members 37 and 38, is blocked. Conversely, the assembly of the two members 37 and 38 and the pivotable element 35 can still be translated along a longitudinal direction because axle 36 of the tipping element can be displaced in oblong holes 39 and 40. The two members become affixed to one another for any longitudinal force causing them to come together.

This is not limiting; other means could also suffice. For example, the ends of members 37 and 38 could come into abutment against one another by direct contact.

Axle 36, about which tipping element 35 is suspended, is located at a sufficient height with respect to the upper surface of base 4, so that the rotation of pivotable element 35 and the translational movements of front and rear members 37 and 38 can occur without interference with the upper surface of base 4. In particular, the ends of members 35 and 38 are slightly raised with respect to base 4 at this level.

Moreover, the assembly constituted by front member 37, pivotable element 35 and rear member 38 can get translated along a longitudinal direction, forwardly or rearwardly. This translation is allowed in light of the fact that axle 36 is borne by the wings of base 4, in the area of oblong holes 39 and 40.

Thus, the translation of one lath in a direction approaching the other can either cause the rotation of pivotable element 35 about the axis of axle 36, or the longitudinal translation of pivotable element 35, and the other lath, by the translation of axle 36 in the oblong holes 39 and 40, or even a combination of both these movements.

Figure 8:
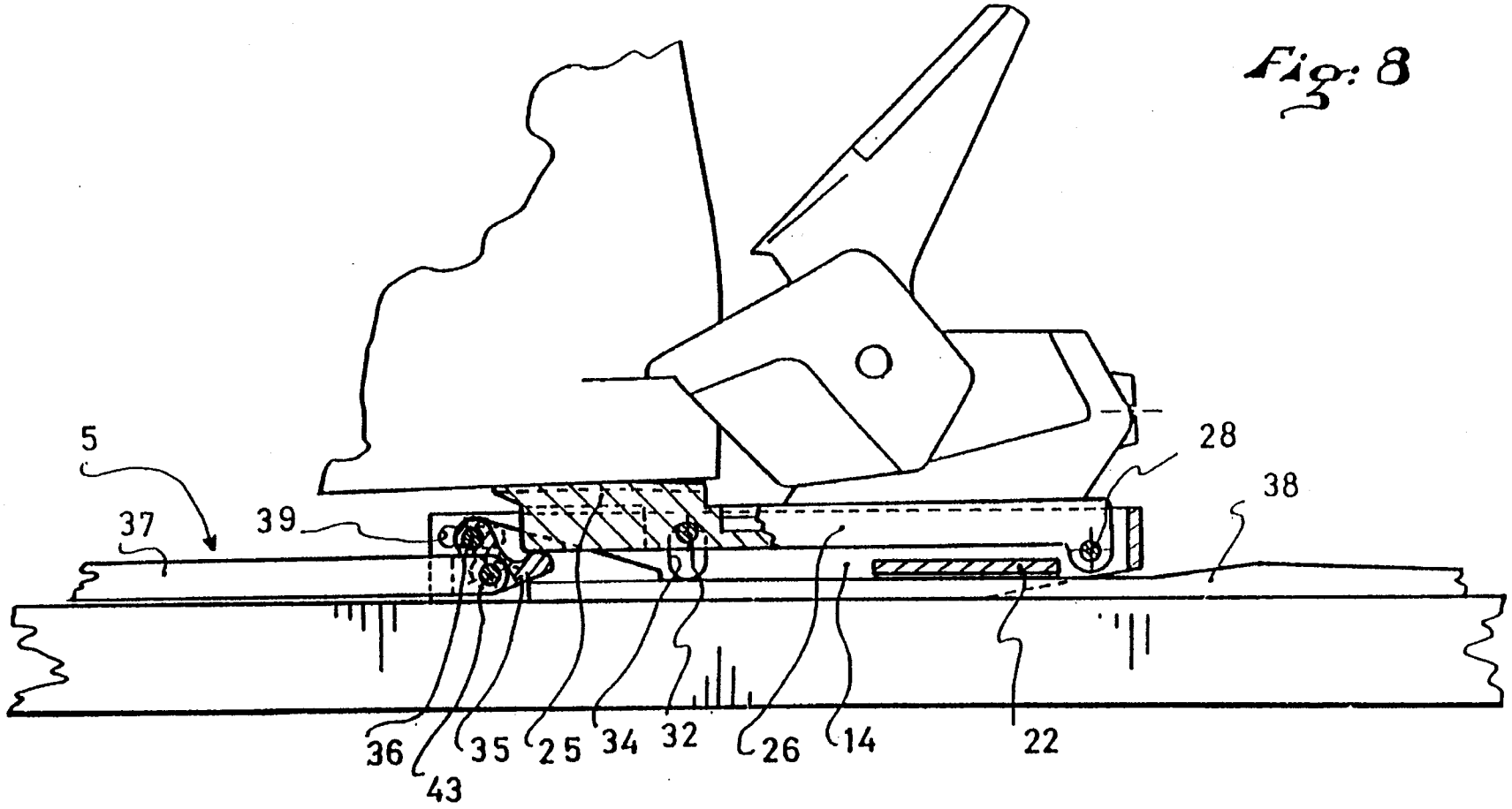
FIG. 8 is a side partial sectional elevation view in the area of the rear binding element, in its resting position.
Figure 9:
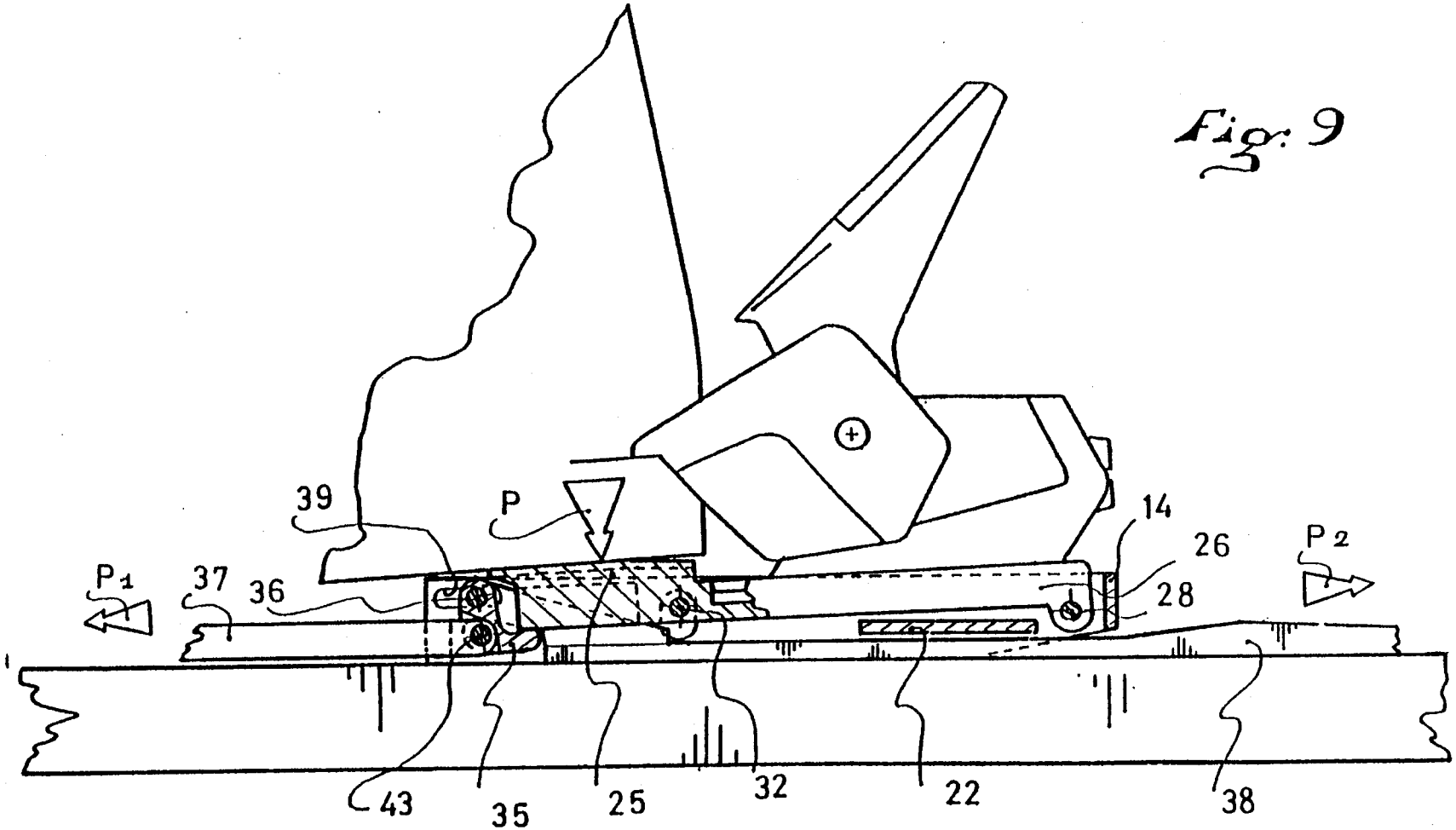
FIG. 9 is a view similar to FIG. 8, the sensor being biased vertically downwardly.

FIGS. 8 and 9 illustrate the operation of the above mentioned device.

In FIG. 8, the rear end of the boot does not exert a downward vertical force on sensor element 25, or rather, the vertical force that the boot exerts on sensor 25 is less than the upward vertical pre-stress to which the device subjects the sensor. Axle 32 is located in upward abutment in slots 33 and 34 of base plate 14. Axle 36, about which pivotable element 35 is suspended, is located approximately in the central portion of oblong holes 39 and 40 present in base plate 14.

Members 37 and 38 are affixed to one another for a bias causing their relative movement toward each other.

In this configuration, as has been described hereinabove, if the front end of the ski is subjected to a flexional bias, the entire assembly constituted by front member 37, pivotable element 35 and rear member 38 is translated rearwardly. This results in the generation, in the area of the rear end of the ski, of a flexional moment tending to make the rear end plunge towards the snow. The inverse is also true, i.e., a flexional bias of the rear end of the ski tends to make the front end plunge frontwardly. During such a forward or rearward translation, pivotable element 35 is displaced in a longitudinal direction beneath plates 46.

In FIG. 9, the boot exerts on sensor 35 an additional downward force schematically represented by arrow P. This force causes the downward pivoting of sensor 25 and slide 26, axle 32 circulating in slots 33 and 34. Pivotable element 35 is rotationally driven about the axis of axle 36, which causes a relative spacing of front and rear members 37 and 38, which has been translated in the drawings by thrust P1 oriented forwardly and thrust P2 oriented rearwardly. These thrusts P1 and P2 respectively generate flexional moments of the front end and the rear end of the ski.

In this system position, as previously mentioned, a flexional bias of the front or rear end of the ski is transmitted by members 37 and 38 and pivotable element 35 to the other end of the ski, in the form of a flexional moment that is added to the flexional moment generated by thrust P.

Such a bias can also cause the rotation of the pivotable element in the direction of members 37 and 38 coming together, and thereby, the rise of sensor 25.

Thus, pressure increase of one end of the ski on the snow, due to the terrain or the position of the skier, is absorbed and sent back to the other end of the ski which is subject to an additional flexional moment tending to make such end plunge towards the snow. In the case where the skier modifies the balancing position on the skis, and especially a rearward displacement of the point of application of the vertical bias exerted by the boot on his or her supports, thrust P increases, which generates an additional flexional moment on the front end and rear end of the ski.

When the skier resumes a normal position, i.e., when bias P decreases, base 4 and members 37 and 38 bring pivotable element 35 back to its initial position, which pushes back sensor 25 and the boot into their raised position.

Depending on the intensity of thrust P exerted by the boot, the sensor moves up or down. This provides an elastic suspension of the boot in a vertical direction. Moreover, sensor 25 does not react to purely lateral biases in view of its journal about the axis of axle 28. These biases are transmitted directly between the boot and base 4.

Figure 10:
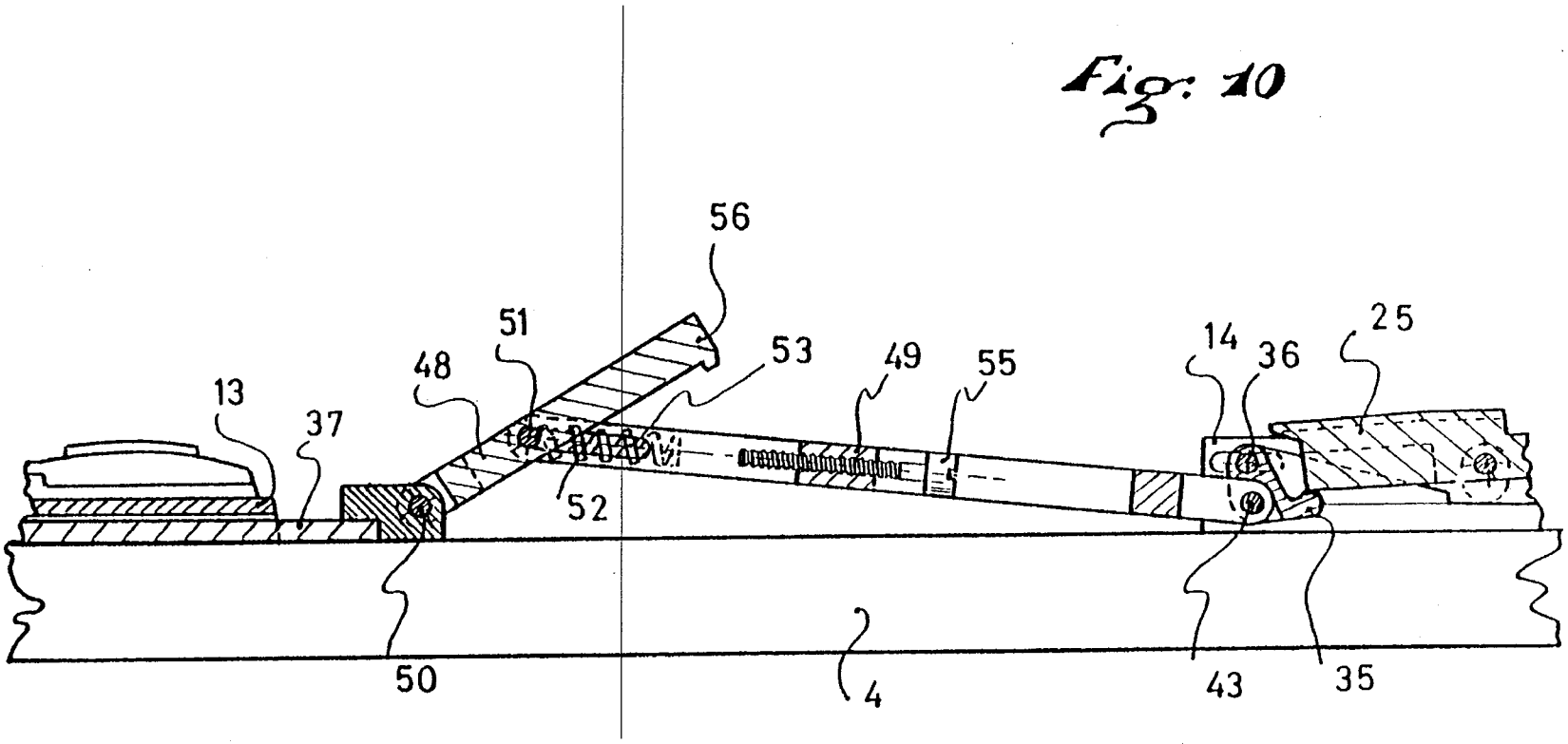
FIG. 10 represents in a side elevation view, and in a partial section, both portions of the front stiffening member, in their resting position.
Figure 11:
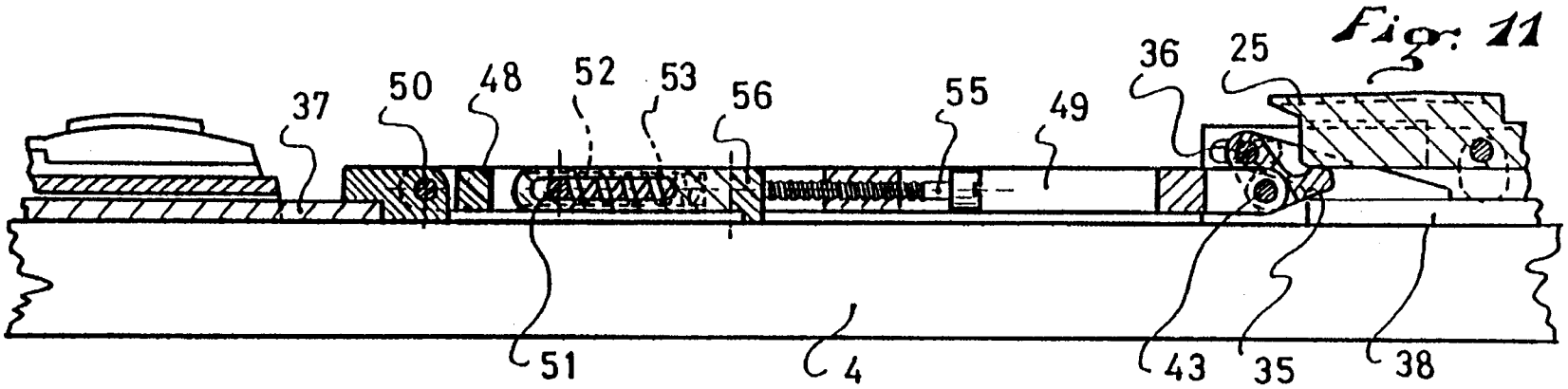
FIG. 11 represents both of these portions in a functional position.
Figure 12:
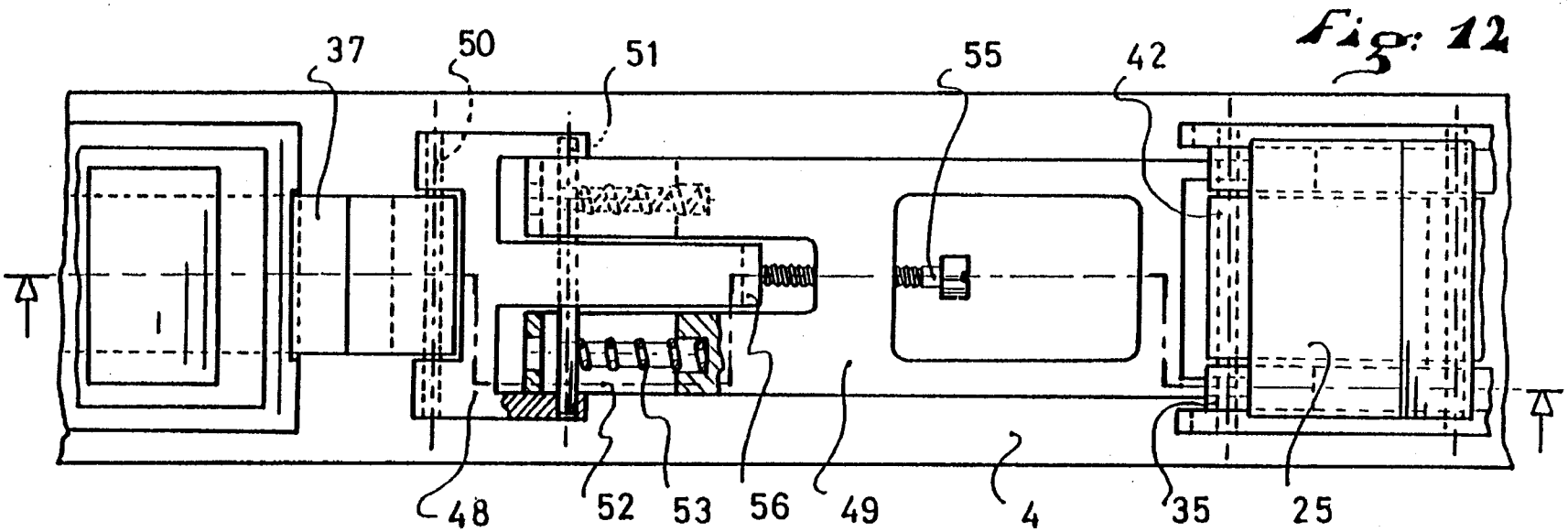
FIG. 12 is a top plan view of both these portions in a functional position.

Preferably, stiffening blade 5 has, at rest, a compression pre-stress so as to be able to bring sensor 25 back upwardly when the skier is in normal support on the ski. According to a preferred embodiment, this pre-stress can be established or even eliminated depending on the presence or absence of the boot. Such a construction is illustrated in FIGS. 10 through 12. According to this construction, front member 37 has, in its rear portion, two elements journaled in the manner of a knuckle joint 48 and 49 that extend along a longitudinal direction of base 4. Both elements 48 and 49 are respectively journaled, in the area of their free end, to front member 37, in the area of an axis 50 and to pivotable element 35, in the area of axle 43 described previously. In addition, both elements 48 and 49 are journaled to one another about a horizontal and transverse axis along axle 51. In one of the two elements, element 49 in the case of the drawings, axle 51 is mounted in a slot 52 oriented along the longitudinal direction of the element. Axle 51 can therefore slide along such slot, and be brought back elastically towards the end of the element by at least one spring 53.

In the absence of the boot, the knuckle joint constituted by elements 48 and 49 can be open, which eliminates any pre-stress in stiffening blade 5. This is illustrated in FIG. 10. It could be, thus, that sensor 25 automatically positions itself in the lowered position if no actual elastic return means maintains it in its raised position.

FIGS. 11 and 12 illustrate the case wherein elements 48 and 49 of the knuckle joint are flattened, which displaces axle 51 in slot 52 against the return force of spring 53. The return spring then generates a compression pre-stress in stiffening blade 5.

To avoid spring 53 from getting additionally compressed while skiing, an abutment is provided to couple, in a fixed manner, along a longitudinal direction, elements 48 and 49 of the knuckle joint. In the case of the drawings, this abutment is constituted by a micrometric screw 55, which is mounted on a brace of element 49, and which is placed in abutment against a longitudinal tongue 56 of element 48. Thus, all the biases or all the longitudinal forces will be directly transmitted from one element of the knuckle joint to the other, without biasing spring 53.

When the boot is absent once again, screw 55 is unscrewed, and then the knuckle joint can be broken to free the ski from the pre-stress.

Figure 13:
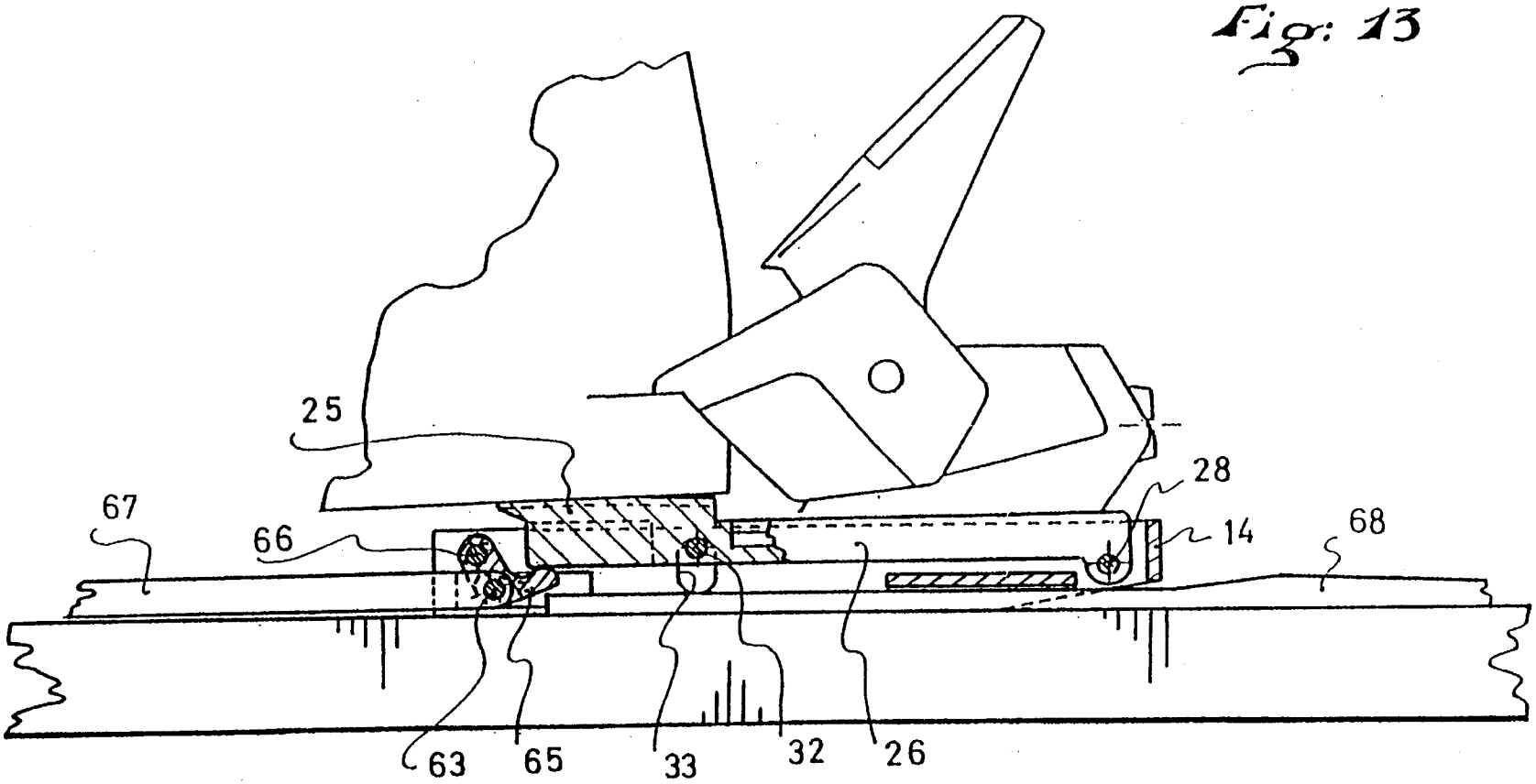
FIG. 13 illustrates a variation of the device represented in the preceding drawing.
Figure 14:
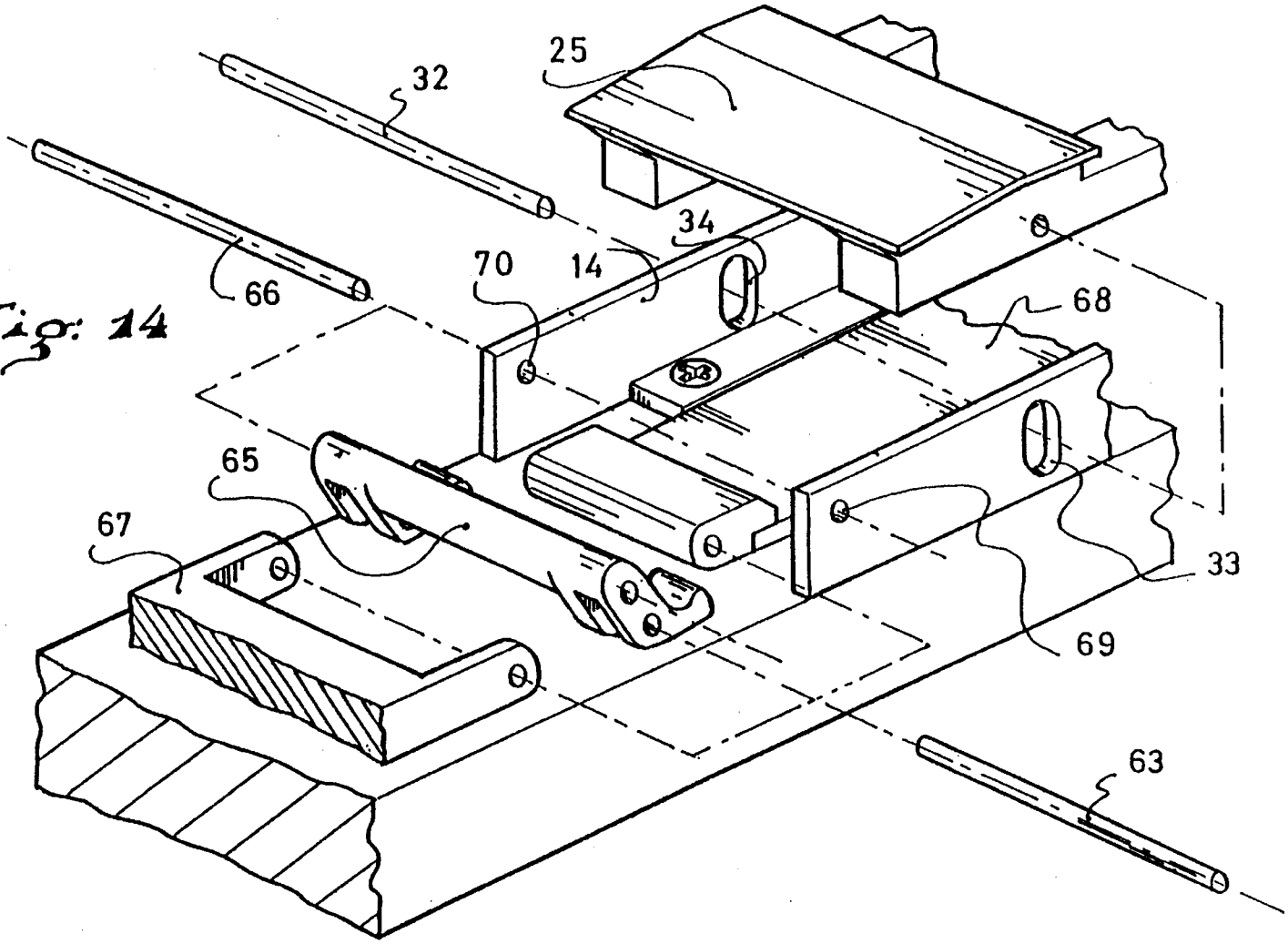
FIG. 14 is a partial exploded perspective view in the area of the sensor and the connection means under the sensor for the device represented in FIG. 13.

FIGS. 13 and 14 illustrate a variation. According to this variation, stiffening blade 5 has a front member 67 and a rear member 68, which are joined together in the area of a pivotable element 65 similar to the previously described pivotable element 35. Members 67 and 68 and pivotable element 65 are journaled to one another about a common axis along axle 63 which is located in the central portion of the pivotable element. Thus, the two members 67 and 68 are fixedly connected to one another for all forward and rearward longitudinal movements. As for pivotable element 65, it is connected to base plate 14 of the rear binding element, in the area of an axle 66 whose ends are borne by openings 69 and 70 of base 14. Contrary to the previous case wherein pivotable element 35 could have a rotational movement and a translational movement, in the present case, pivotable element 65 only has one possible rotational movement about the axis of axle 66.

In the case of this variation, the downward vertical biases of the boot on sensor 25 are transmitted to stiffening blade 5, in the form of a forwardly oriented thrust force, which is exerted both on the front member as well as on the rear member.

In parallel to this, a flexional bias of the front end of the ski can be transmitted to the rear member, insofar as sensor 25 is not in upward abutment, i.e., where pin 32 is not in abutment in slots 33 and 34 of base plate 14. On the other hand, a flexional bias of the rear end of the ski can be transmitted to front member 67, but it causes a displacement of axle 63 and a lowering of sensor element 25.

Figure 15:
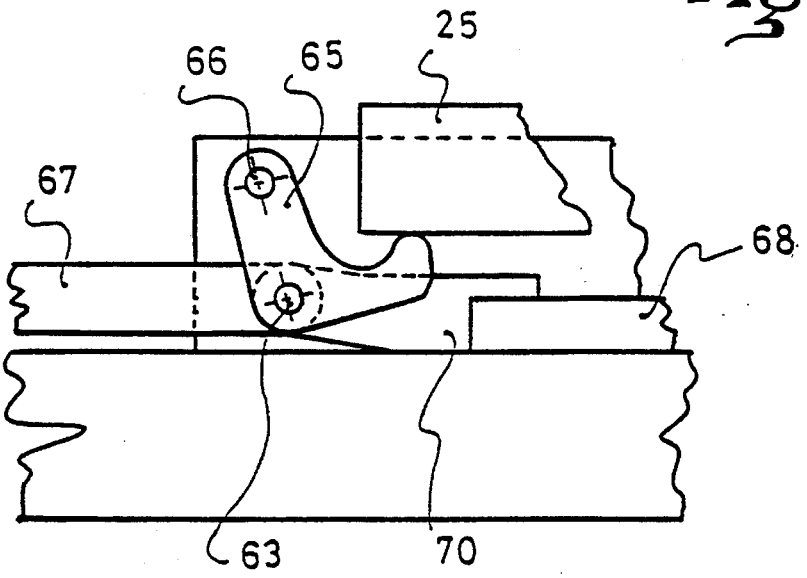
FIGS. 15 and 16 represent an a variation of the preceding embodiment.
Figure 16:
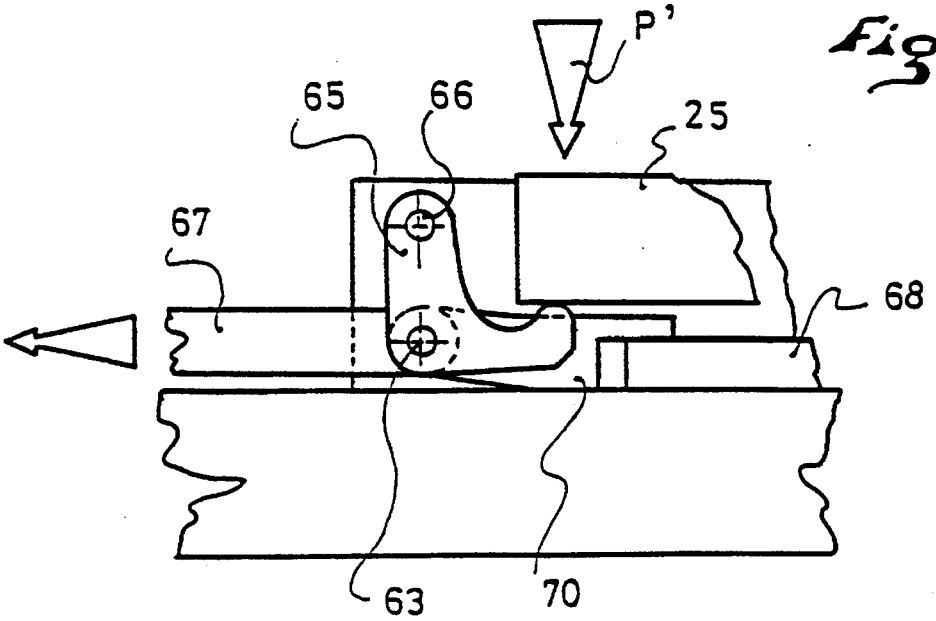

FIGS. 15 and 16 illustrate a variation, according to which the two front and rear members 67 and 68 are only fixedly connected for a rearward translational movement of member 67. For example, as is illustrated, rear member 68 is in simple support along a forward longitudinal direction, against a connection element 70. It is this connection element 70 that is connected to pivotable element 65 and to front member 67 about the journal axle 63. FIG. 16 illustrates the operation of this variation in the case where pivotable element 65 is rotationally driven by the effect of a thrust P'. Front member 67 is thus translationally driven forwardly. Inversely, rear member 68 is free to follow or not to follow this translational movement depending on the flexional bias to which the rear end of the ski is subjected. In this case, the connection means only send the biases captured by sensor element 25 towards the front end of the ski. On the contrary, when the sensor is in the raised position, i.e., as in the case of FIG. 15, a flexional bias that is exerted on the rear end of the ski is transmitted to front member 67, from the moment at which rear member 68 is in abutment against connection element 70.

Figure 17:
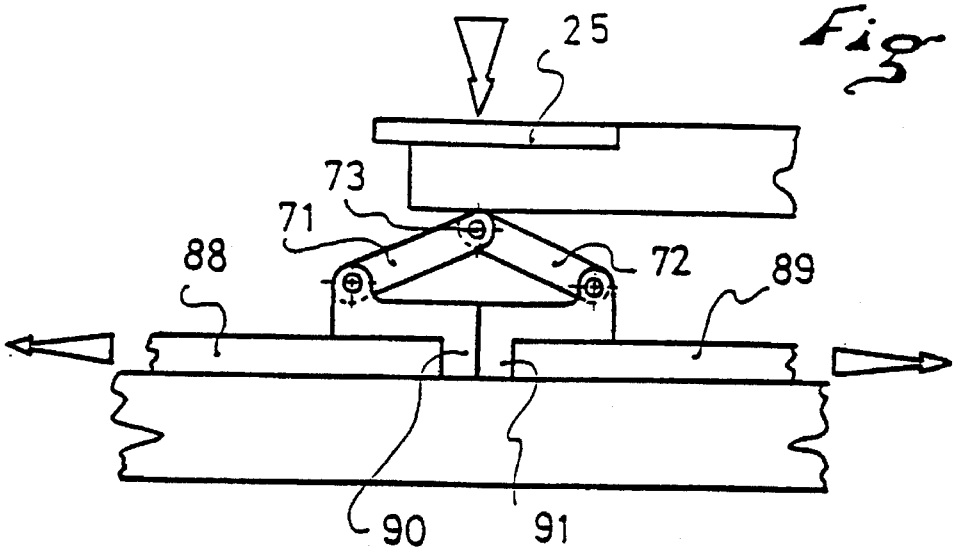
FIGS. 17 through 19 illustrate variations of the connection means between the sensor and the stiffeners.
Figure 18:
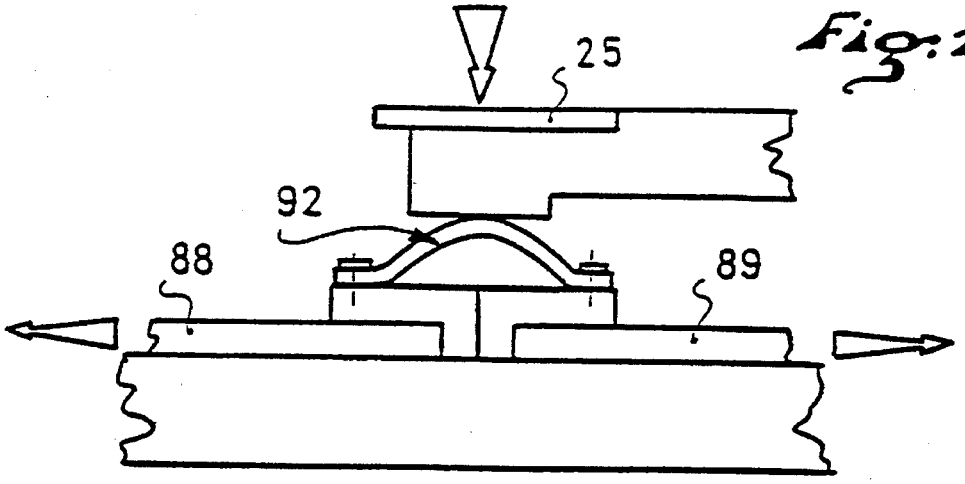
Figure 19:
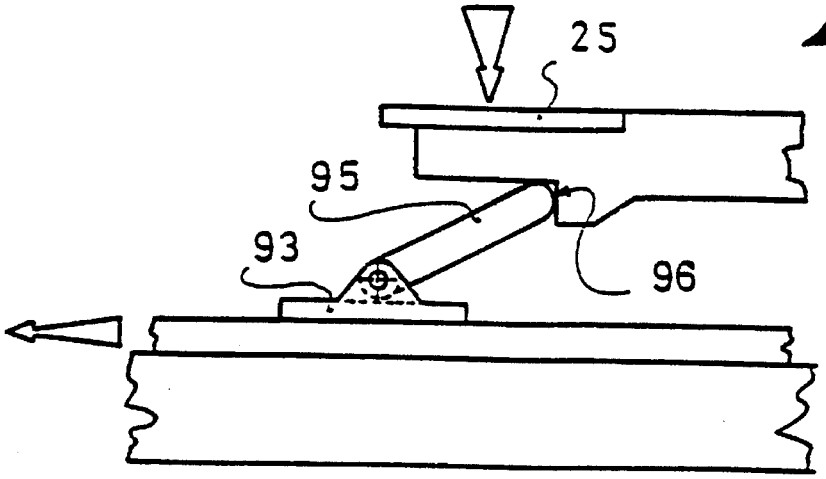

FIGS. 17 through 19 are related to variations of the previously described connection means.

According to FIG. 17, the connection means between sensor element 25 and stiffening blade 5 are constituted by a knuckle joint device constituted of two levers 71 and 72, whose free ends are respectively journaled at the end of each of the front and rear members. Sensor 25 is in support in the area of journal axle 73 which is common to both levers 71 and 72. It is to be understood that a downward thrust of sensor 25 on the knuckle joint causes a flattening thereof, and thereby a relative spacing of both front and rear members 88 and 89. Preferably, according to this variation, the two front and rear laths 88 and 89 are in abutment against one another, along a longitudinal direction, when the knuckle joint is in its resting position which corresponds to the raised position of sensor 25. For example, the ends of members 88 and 89 can be equipped with abutment elements 90 and 91, that come into contact with one another, and that moreover, bear the journal axes to which the free ends of levers 71 and 72 are connected.

FIG. 18 illustrates another embodiment, according to which the knuckle joint device is replaced by a strip 92 convex upwardly, whose ends are connected to each of the front and rear members. Sensor 25 is in support against the convex strip 92 in the central portion thereof. It is to be understood that a downward vertical bias, exerted by the sensor on strip 92, causes a flattening thereof, i.e., a relative spacing of the front and rear members 88 and 89.

FIG. 19 represents another variation, in the case where the stiffening blade is constituted by one and the same element. In this case, the stiffening blade carries a bearing 93 to which an oblique lever 95 is journaled, such lever being oriented in the top to bottom and rear to front direction. The free end of lever 95 is in support against a longitudinal abutment 96 that the slide has beneath sensor 25. It is understood that a downward movement of sensor 25 tends to make lever 95 pivot towards the ski, which forces bearing 93 to get translated towards the front of the ski.

It is understood that the invention is not limited to the various embodiments and variations described hereinabove. Other embodiments and variations could in fact be envisioned by a person skilled in the art, without leaving the scope of the invention.

In addition, sensor element 25 could be associated to the front binding element, or even be independent of both binding elements. The sensor element could also be independent of the front and rear support elements on which the boot rests. For example, it could be placed at the level of the central portion of the boot between its front and rear supports.

In particular, the knuckle joint that enables blade 5 to be pre-stressed and the variations of the connection means could equip any of the embodiments described hereinabove.

We claim:

1. A device for modifying force distribution of a ski over a gliding surface of the ski, the ski having a lower base, the lower base having a central zone, a forward portion and a rearward portion, said device comprising:

an elongated stiffening blade having a front end and a rear end, the front end of the stiffening blade being adapted to be affixed to the forward portion of the lower base of the ski and the rear end of the stiffening blade being adapted to be affixed to the rearward portion of the lower base of the ski;

a sensor element for supporting only a portion of the sole of the boot and for capturing a vertical thrust force of the boot; and a connection between the sensor element and the stiffening blade for transmitting to the stiffening blade, in the form of a force oriented generally horizontally and in a longitudinal direction toward at least one of the front end of the stiffening blade and the rear end of the stiffening blade, at least a portion of the vertical thrust force of the boot.

2. A device according to claim 1, further comprising:

an arrangement to enable the sensor element to move along a vertical direction and an abutment for limiting upward movement of the sensor element.

3. A device according to claim 1, wherein:

said stiffening blade comprises a front longitudinally extending member and a rear longitudinally extending member, said front stiffening member and rear stiffening member being longitudinally co-extensive and longitudinally movable with respect to each other to and from a longitudinally abutting engagement, whereby said connection is between said sensor and at least one of said front and rear longitudinally extending members for transmitting to said one of said front and rear longitudinally extending members said force, said force being operative to space apart said front and rear longitudinally extending members.

4. A device according to claim 3, wherein:

said connection between the sensor element and the stiffening blade comprising a pivotable element having a pair of arms that project in different directions;

a generally horizontal and transverse first axle connecting said front stiffening member to said pivotable element and a generally horizontal and transverse second axle connecting said rear stiffening member to said pivotable element;

said pivotable element having a support surface engageable with said sensor element for receiving the vertical thrust force of the boot and causing the pivotable element to pivot in a predeterminate direction for causing said front and rear stiffening members to become longitudinally spaced apart.

5. A device according to claim 4, further comprising:

a base adapted to be affixed to the ski, the base comprising a pair of transversely spaced apart wings having respective openings that are longitudinally elongated, one of said first axle and said second axle having opposite ends, each of the opposite ends extending through a respective one of said elongated openings for suspending said pivotable element from said base so that said pivotable element can be translated longitudinally along said base.

6. A device according to claim 5, wherein:

a base adapted to be affixed to the ski, the base comprising a pair of transversely spaced apart wings having respective openings that are longitudinally elongated;

said first axle being located at an upper portion of said pivotable element, said first axle having opposite ends, each of the opposite ends extending through a respective one of said elongated openings for suspending said pivotable element from said base so that said pivotable element can be translated longitudinally along said base.

7. A device according to claim 3, wherein:

said connection between the sensor element and the stiffening blade for transmitting at least a portion of the vertical thrust force of the boot as a generally horizontal and longitudinal force to the stiffening blade comprises a knuckle joint device constituted by two levers journalled with respect to each other about a common horizontal and transverse axis, an end of one of said two levers being connected to one of the front and rear stiffening members, an end of the other of said two levers being connected to the other of the front and rear stiffening members, and the sensor element being supported by a central portion of said knuckle joint device.

8. A device according to claim 3, wherein:

said connection between the sensor element and the stiffening blade for transmitting at least a portion of the vertical thrust force of the boot as a generally horizontal and longitudinal force to the stiffening blade comprises a strip of material having an upper central convex portion, one end of the strip being connected to one of the front and rear stiffening members and the other end of the strip being connected to the other of the front and rear stiffening members, and the sensor element being supported by a central portion of said strip of material.

9. A device according to claim 3, wherein:

said sensor element rests in direct support on a portion of said connection between the Sensor element and the stiffening blade which transmits the vertical thrust force of the boot to the front and rear stiffening members.

10. A device according to claim 6, wherein:

said front stiffening member comprises a rear end surface and said rear stiffening member comprises a front end surface, said rear end surface of said front stiffening member being in longitudinal abutting support against said front end surface of said rear stiffening member for transmitting, toward one of said front end of the stiffening blade and said rear end of the stiffening blade, flexional forces of the ski sensed by the other of said front and rear ends of the stiffening blade.

11. A device according to claim 1, wherein:

said stiffening blade comprises means for ensuring longitudinal movement of said stiffening blade as an integral assembly for transmitting the vertical thrust of the boot into a longitudinally directed force to a single one of the front end and the rear end of said stiffening blade.

12. A device according to claim 11, wherein:

said connection between the sensor element and the stiffening blade comprises a pivotable element having a pair of arms;

a generally horizontal and transverse first axle about which the pivotable element is journalled;

a base adapted to be affixed to the ski, said base bearing the first axle;

a second axle borne by the pivotable element for journalling the stiffening blade to the pivotable element;

said pivotable element having a support surface engageable with said sensor element for receiving the vertical thrust force of the boot and causing the pivotable element to pivot about the first axle and transmitting to the stiffening blade said force oriented generally horizontally and in said longitudinal direction toward the front end of the stiffening blade.

13. A device according to claim 11, wherein:

said connection between the sensor element and the stiffening blade for transmitting at least a portion of the vertical thrust force of the boot as a generally horizontal and longitudinal force to the stiffening blade comprises an inclined lever extending between a longitudinal abutment, vertically movable with said sensor element, and a bearing affixed to the stiffening blade.

14. A device according to claim 1, further comprising:

said stiffening blade comprises a front stiffening member and a rear stiffening member, the rear stiffening member having a rear end and a front end, the rear end of the rear stiffening member being adapted to be affixed to a rearward portion of the ski, the front end of the rear stiffening member being adapted to be located in the central zone of the lower base of the ski and being in simple support against said front stiffening member;

said connection between the sensor element and the stiffening blade not being connected to said rear stiffening member, said rear stiffening member being in direct longitudinal abutment with said front stiffening member.

15. A device according to claim 1, wherein:

said stiffening blade comprises means for compression pre-stressing.

16. A device according to claim 1, wherein:

said stiffening blade comprises two longitudinally extending members journalled about a common transverse axis, said two longitudinally extending members being movable between:

(1) a flattened position in the presence of the boot, in which said common transverse axis is moved downwardly and said two longitudinally extending members are generally longitudinally co-extensive and generate an initial longitudinally directed pre-stress, and (2) an open position in the absence of the boot, in which the pre-stress is removed.

17. A device according to claim 16, wherein:

a journal axle extending along said common transverse axis;

wherein one of said two longitudinally extending journalled members of the stiffening blade comprises means for mounting said journal axle for sliding longitudinally with respect to the other of said two longitudinally extending journalled members; and wherein at least one spring is located on said other of said two longitudinally extending journalled members for providing an elastic return force against said one of said two longitudinally extending journalled members.

18. A device according to claim 17, wherein:

said two longitudinally extending journalled members of the stiffening blade further comprise an abutment device for placing said two longitudinally extending journalled members in rigid longitudinal support in said flattened position.

19. A device according to claim 1, wherein:

said connection comprises means for transforming vertical movement of said sensor, in response to said vertical thrust, to longitudinal movement of a portion of said stiffening blade with respect to a portion the ski.

20. A device according to claim 1, wherein:

said stiffening blade is elongated for extending beneath the sole of the boot; and said device further comprises means for mounting said stiffening blade for longitudinal movement with respect to said sensor.

21. device according to claim 1, wherein:

said stiffening blade comprises a longitudinally extending front stiffening member and a longitudinally extending rear stiffening member;

said device comprises means for mounting said front stiffening member and rear stiffening member to move either rearwardly or forwardly with respect to the boot in response to flexion of an end of the ski independent of said longitudinally directed force transmitted by said connection between said sensor and said stiffening blade.

22. A device for modifying force distribution of a ski over a gliding surface of the ski, the ski having a lower base having a central zone, said device comprising:

a front binding element for retaining a front of a boot and a rear binding element for retaining a rear of the boot, said front binding element and said rear binding element being adapted to be mounted within the central zone of the ski;

an elongated stiffening blade having a front end and a rear end, the front end of the stiffening blade being adapted to be affixed to a forward portion of the lower base of the ski and the rear end of the stiffening blade being adapted to be affixed to a rearward portion of the lower base of the ski, the forward portion and the rearward portion of the lower base of the ski being beyond respective ends of the central zone;

a sensor element, mounted proximate the rear binding element, for supporting only a rear portion of the sole of the boot and for capturing a vertical thrust force exerted by said rear portion of the boot; and a connection between the sensor element and the stiffening blade for transmitting to the stiffening blade, in the form of a force oriented generally horizontally and in a longitudinal direction toward at least one of the front end of the stiffening blade and the rear end of the stiffening blade, at least a portion of the vertical thrust force of the boot.

23. A device according to claim 22, wherein:

a rear base plate adapted to be affixed to the ski;

a slide bearing a generally horizontal and transverse axle for journalling said slide with respect to said rear base plate;

a body for the rear binding element;

means for mounting said body with respect to said slide;

wherein said sensor element is affixed to said slide.

24. A device according to claim 23, further comprising:

a front base plate adapted to be affixed to the ski adapted to support the front binding element, said front base plate having a longitudinally extending recess;

said stiffening blade extending through said longitudinally extending recess of said front base plate.

25. A device according to claim 22, wherein:

said connection comprises means for transforming vertical movement of said sensor, in response to said vertical thrust, to longitudinal movement of a portion of said stiffening blade with respect to a portion of the ski.

26. A device according to claim 22, wherein:

said stiffening blade is elongated for extending beneath the sole of the boot; and said device further comprises means for mounting said stiffening blade for longitudinal movement with respect to said sensor.

27. A device according to claim 22, wherein:

said stiffening blade comprises a longitudinally extending front stiffening member and a longitudinally extending rear stiffening member;

said device comprises means for mounting said front stiffening member and rear stiffening member to move either rearwardly or forwardly with respect to the boot in response to flexion of an end of the ski independent of said longitudinally directed force transmitted by said connection between said sensor and said stiffening blade.

28. A ski having a lower base extending in a longitudinal direction, the lower base curved upwardly toward the front end to form a shovel, the lower base furthermore having a central zone, said ski comprising:

a front binding element for retaining a front of a boot on the ski and a rear binding element for retaining a rear of the boot on the ski, said front binding element and said rear binding element being mounted within the central zone of the ski, the central zone of the ski extending beyond said front binding element and beyond said rear binding element;

a device for modifying a force distribution of the ski over a gliding surface of the ski, said device including an elongated stiffening blade having a front end and a rear end, the front end of the stiffening blade being affixed to a forward portion of the lower base of the ski and the rear end of the stiffening blade being affixed to a rearward portion of the lower base of the ski, the forward portion and the rearward portion of the lower base of the ski being beyond respective ends of the central zone;

a sensor element, mounted proximate the rear binding element, for supporting only a rear portion of the sole of the boot and for capturing a vertical thrust force exerted by said rear portion of the boot; and a connection between the sensor element and the stiffening blade for transmitting to the stiffening blade, in the form of a force oriented generally horizontally and in said longitudinal direction toward at least one of the front end of the stiffening blade and the rear end of the stiffening blade, at least a portion of the vertical thrust force of the boot.

29. A ski according to claim 28, wherein:

said connection comprises means for transforming vertical movement of said sensor, in response to said vertical thrust, to longitudinal movement of a portion of said stiffening blade with respect to a portion of the ski.

30. A ski according to claim 28, wherein:

said stiffening blade is elongated for extending beneath the sole of the boot; and said device further comprises means for mounting said stiffening blade for longitudinal movement with respect to said sensor.

31. A ski according to claim 28, wherein:

said stiffening blade comprises a longitudinally extending front stiffening member and a longitudinally extending rear stiffening member;

said device comprises means for mounting said front stiffening member and rear stiffening member to move either rearwardly or forwardly with respect to the boot in response to flexion of an end of the ski independent of said longitudinally directed force transmitted by said connection between said sensor and said stiffening blade.

* * * * *